US006158441A

United States Patent [19]

Grigutsch et al.

[11] Patent Number: 6,158,441

[45] Date of Patent: Dec. 12, 2000

[54] METHOD OF AND APPARATUS FOR APPLYING A CONDITIONING AGENT TO TOBACCO

[75] Inventors: Torsten Grigutsch, Hamburg; Dieter Paus, Reinbek, both of Germany

[73] Assignee: Hauni Maschinenbau AG, Hamburg, Germany

[21] Appl. No.: 09/131,733

[22] Filed: Aug. 10, 1998

[30] Foreign Application Priority Data

Aug. 8, 1997 [DE] Germany ..... 197 34 364

[51] Int. Cl.[7] ..... A24B 3/18

[52] U.S. Cl. ..... 131/296; 131/304

[58] Field of Search ..... 131/300, 302, 131/304, 900, 291, 296

[56] References Cited

U.S. PATENT DOCUMENTS

| | | | |
|---|---|---|---|
| 4,757,830 | 7/1988 | Halliday | 131/302 |
| 4,791,942 | 12/1988 | Rickett et al. | 131/291 |
| 4,967,769 | 11/1990 | Franklin et al. . | |
| 5,311,885 | 5/1994 | Yoshimoto et al. | 131/291 |
| 5,740,817 | 4/1998 | Cunningham | 131/291 |

FOREIGN PATENT DOCUMENTS

| | | |
|---|---|---|
| 0 215 593 | 3/1987 | European Pat. Off. . |
| 0 528 227 | 2/1993 | European Pat. Off. . |
| 0 546 986 | 6/1993 | European Pat. Off. . |
| 95 01108 | 1/1995 | WIPO . |

*Primary Examiner*—Stanley S. Silverman
*Assistant Examiner*—Robert McBride
*Attorney, Agent, or Firm*—Venable; George H. Spencer; Robert Kinberg

[57] ABSTRACT

A shower of tobacco particles is admitted into the inlet at the top of and descends by gravity and/or under the action of a driven cell wheel in a generally upright duct. The particles are moisturized prior to admission into the duct or due to contact with droplets of water in the inlet, and are thereupon caused to traverse an orbiting shower of steam, water and/or another conditioning medium in an intermediate portion of their path in the duct. Such treatment entails a swelling and thus increases the volume of the particles. The conditioning medium is discharged via orifices radially outwardly from at least one substantially horizontal conduit which is rotated about its axis and can be provided with external pins or analogous mechanical impellers serving to cause the particles of tobacco to orbit about the conduit prior to descending into the range of a dryer at a level below the intermediate portion of the path, e.g., at the outlet of the duct.

10 Claims, 3 Drawing Sheets

METHOD OF AND APPARATUS FOR APPLYING A CONDITIONING AGENT TO TOBACCO

CROSS-REFERENCE TO RELATED APPLICATION

This application claims the priority of German Application 19734364.3 filed Aug. 8 1997, the subject matter of which is incorporated herein by reference.

BACKGROUND OF THE INVENTION

The invention relates to improvements in methods of and in apparatus for conditioning tobacco. More particularly, the invention relates to improvements in methods of and in apparatus for applying to tobacco particles a conditioning agent. Still more particularly, the invention relates to improvements in methods of and in apparatus for intimately contacting moist tobacco particles with water, steam, vapor and/or other suitable fluid conditioning medium, especially for the purpose of causing the tobacco particles to swell, i.e., to increase the specific volumes of such particles.

It is well known to subject comminuted tobacco ribs and/or comminuted tobacco leaf laminae to a variety of treatments which involve contacting the comminuted ribs and/or leaf laminae (hereinafter called tobacco particles) with a fluid medium. Such particles are thereupon converted into rod-like fillers of cigarettes or other rod-shaped smokers' products; alternatively, the treatment can merely involve a single stage of a composite treatment which can further involve one or more steps prior to and/or subsequent to an increase of the specific volume of the particles.

Manufacturers of cigarettes and/or other rod-shaped articles of the tobacco processing industry are particularly interested in ensuring a pronounced increase of the so-called filling power of tobacco, i.e., in a pronounced increase of specific volume, because this ensures that the articles exhibit a pronounced resistance to deformation without any, or any undue, increase in the quantity of tobacco particles. A heretofore known procedure involves the steps of moistening the particles, thereafter contacting the moistened particles with water vapors, and subsequently drying the moistened and vapor-treated particles.

OBJECTS OF THE INVENTION

An object of the invention is to provide a novel and improved method of effectively, predictably and reliably increasing the specific volume of particulate smokable material.

Another object of the invention is to provide a novel and improved method of treating moisturized tobacco particles.

A further object of the invention is to provide a reliable method of increasing the volumes of large quantities of tobacco particles per unit of time.

An additional object of the invention is to optimize the treatment of tobacco particles subsequent to moisturizing and prior to drying.

Still another object of the invention is to provide a novel and improved apparatus for the practice of the above outlined method.

A further object of the invention is to provide a simple, compact, inexpensive, reliable and versatile apparatus for increasing the specific volumes of comminuted tobacco ribs and/or comminuted tobacco leaf laminae.

Another object of the invention is to provide the above outlined apparatus with novel and improved means for conveying comminuted tobacco leaves through a series of conditioning stations.

An additional object of the invention is to provide the above outlined apparatus with a novel and improved system for the establishment of intimate contact between a fluid conditioning medium and tobacco particles with attendant pronounced swelling of the thus treated particles.

Still another object of the invention is to provide a production line which embodies one or more tobacco conditioning apparatus of the above outlined character.

A further object of the invention is to provide the above outlined apparatus with a plurality of conditioning units which can be designed to contact moisturized tobacco particles with one and the same fluid conditioning medium or with a plurality of different conditioning media.

Another object of the invention is to provide rod-shaped smokers' products containing rod-like fillers of tobacco particles which have undergone a conditioning treatment in accordance with the above outlined method and/or in the above outlined conditioning apparatus.

An additional object of the invention is to provide the above outlined apparatus with a novel and improved system for simultaneously subjecting tobacco particles to a plurality of treatments, particularly for contacting tobacco particles with a moisturizing medium and simultaneously agitating the particles in at least one novel and improved manner.

SUMMARY OF THE INVENTION

One feature of the instant invention resides in the provision of a method of intimately contacting moist tobacco particles with a fluid conditioning medium. The improved method comprises the steps of establishing a preferably essentially gravitational downward flow of moist tobacco particles along a predetermined path, and inducing at least one substantially circular flow of the conditioning medium in a selected portion of the predetermined path so that the tobacco particles traverse and are contacted by conditioning medium in the substantially circular flow.

The at least one circular flow is preferably set up in such a way that it contains an orbiting curtain of conditioning medium.

The inducing step can comprise conveying a stream of a suitable conditioning medium (e.g., steam) along a second path at least substantially transversely of and at least partially across the selected portion of the predetermined path for tobacco particles, discharging streamlets or jets (hereinafter called jets) of conditioning medium from and at least substantially radially of the second path, and orbiting the jets about the second path in the preselected portion of the predetermined path.

Steam is one of presently preferred conditioning media; the purpose of the conditioning medium or media is to effect an increase of the specific volume of tobacco particles which traverse the selected portion of the predetermined path.

Still further, the method can comprise the step of moisturizing the particles of tobacco in a second portion of the predetermined path upstream of (i.e., normally at a level above) the preselected portion of such predetermined path.

The method can also comprise the step of reducing the moisture content of tobacco particles in a further portion of the predetermined path subsequent to contacting of the particles with the conditioning medium in the selected portion of the predetermined path. Otherwise stated, such additional step can involve drying of the tobacco particles subsequent to traversal by the particles of the selected portion of the predetermined path.

A presently preferred inducing step includes supplying the conditioning medium into the selected portion of the predetermined path in the form of an array of jets containing atomized or essentially atomized conditioning medium and issuing substantially radially from a source extending transversely of and across the selected portion of the predetermined path, and orbiting the jets around the source.

Still further, the inducing step can include establishing a plurality of at least substantially circular flows of atomized conditioning medium in successive selected portions of the predetermined path, e.g., in two successive selected portions one of which is or can be located at a level above the other selected portion. The establishing step can comprise confining tobacco particles to a movement substantially vertically downwardly through the selected portion of the predetermined path. As used herein, the term "substantially vertically downwardly" can involve any movement which has a vertical component or is exactly vertical.

Another feature of the invention resides in the provision of an apparatus for contacting moist tobacco particles with a fluid conditioning medium. The apparatus comprises a first conveyor defining a predetermined path for an essentially gravitational downward flow of tobacco particles, and at least one second conveyor for a stream of conditioning medium. The at least one second conveyor is arranged to establish a second path extending at least substantially transversely of a selected portion of the predetermined path and having orifices arranged to discharge jets of conditioning medium substantially radially outwardly from the second path and to orbit the jets around the second path in the selected portion of the predetermined path.

The at least one second conveyor can comprise an elongated conduit having a substantially horizontal axis and being driven to rotate about such axis.

As already mentioned above, the conditioning medium contains or should contain a fluid which effects a swelling (i.e., an increase of specific volume) of tobacco particles in the selected portion of the predetermined path.

The at least one second conveyor can comprise, or can cooperate with, means for mechanically propelling tobacco particles to orbit about the second path in the selected portion of the predetermined path. This establishes a longer-lasting contact between tobacco particles and the atomized conditioning medium. If the second conveyor comprises an elongated conduit having a substantially horizontal axis and being driven to rotate about such axis, the means for mechanically propelling tobacco particles can comprise impellers (e.g., in the form of straight or substantially straight elongated pins or needles) extending from and substantially radially of the conduit.

The first conveyor can be provided with an inlet for the admission of tobacco particles into the predetermined path, and the apparatus can further comprise means for contacting tobacco particles with a moisturizing agent at the inlet of the first conveyor. The moisturizing agent can contain water, and the means for contacting tobacco particles with such moisturizing agent can include at least one nozzle arranged to discharge moisturizing agent (e.g., an atomized agent) into the inlet so that the particles can be influenced by such moisturizing agent before they enter the range of the conditioning medium in the single or in the first or foremost selected portion of the predetermined path.

The apparatus can further comprise means for advancing tobacco particles into the inlet of the first conveyor or from such inlet into the selected portion of the first path; the advancing means can comprise a driven rotary cell wheel which is provided in or adjacent the first conveyor, particularly at the inlet of the first conveyor.

Still further, the improved apparatus can comprise a tobacco dryer which is provided at an outlet of the first conveyor, for example, at the lower end of a substantially upright duct which constitutes or forms part of the first conveyor.

The apparatus can comprise a plurality of second conveyors which can be disposed one below the other in discrete selected portions of the predetermined path. The second conveyors may but need not be at least substantially identical. For example, at least one of two or more second conveyors can comprise means for mechanically propelling tobacco particles to orbit about the respective second path in the corresponding selected portion of the predetermined path.

The inlet of the first conveyor can be disposed at a level above the only or above the topmost second conveyor, and the outlet of the first conveyor can be located at a level below the only or below the lowermost second conveyor.

A further feature of the invention resides in the provision of a conditioning unit for a flow of tobacco particles which are confined to an advancement along a predetermined path. The conditioning unit comprises a rotary tubular conveyor for a stream of a fluid conditioning medium. The conveyor extends at least substantially transversely of a selected portion of the predetermined path for tobacco particles and has a plurality of orifices arranged to discharge orbiting jets of conditioning medium from the stream into the tobacco particles in the selected portion of the predetermined path.

The conduit can be provided with external mechanical impellers for orbiting tobacco particles about the conduit in the selected portion of the predetermined path.

The conditioning medium can contain or can consist of steam, and the improved conditioning unit further comprises means for connecting the conduit with a source of the selected conditioning medium or media. The conditioning medium can also contain or consist of water; the conduit is then connected to a suitable source of water which is used as, or as a part of, the conditioning medium.

Still further, the conditioning unit can comprise or cooperate with means for treating tobacco particles in the predetermined path at a level above the selected portion of such path; the tobacco treating means can comprise means for mosturizing tobacco particles at an inlet of the predetermined path.

Last but not least, the improved conditioning unit can comprise means for conditioning tobacco particles in the predetermined path at a level at least partially below the selected portion of such path; the conditioning can involve renewed contacting of tobacco particles with steam or the like to further increase the specific volume of treated tobacco, or another type of treatment (e.g., drying at the outlet of the predetermined path).

The novel features which are considered as characteristic of the invention are set forth in particular in the appended claims. The improved conditioning apparatus itself, however, both as to its construction and the mode of assembling and/or operating the same, together with numerous additional important features, advantages and attributes thereof, will be best understood upon perusal of the following detailed description of certain presently preferred specific embodiments with reference to the accompanying drawings.

DESCRIPTION OF PREFERRED EMBODIMENTS

Figure 1:
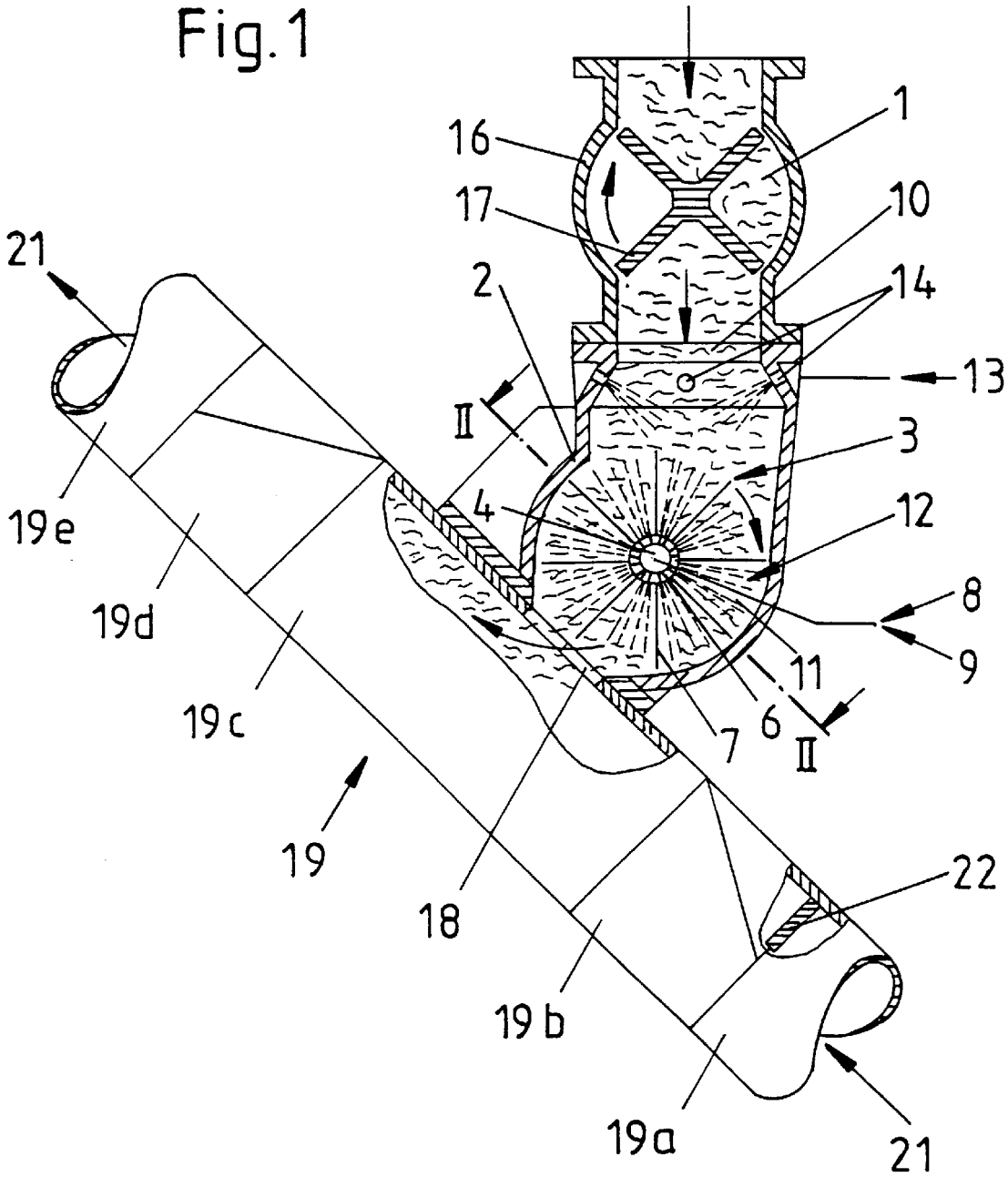
FIG. 1 is a fragmentary partly elevational and partly vertical sectional view of a tobacco conditioning apparatus which embodies one form of the invention.

FIG. 1 shows a first embodiment of the improved tobacco conditioning apparatus. This apparatus comprises a first conveyor 2 in the form of an upright duct for a downward flow of a shower of tobacco particles 1 (e.g., shredded and/or otherwise comminuted tobacco leaves). The purpose of the apparatus is to increase the specific volume of (i.e., to expand) the tobacco particles 1 on their way from the inlet 10 at the upper end toward and through the outlet 18 at the lower end of the duct 2.

A selected intermediate portion of the generally vertical path defined by the duct 2 is traversed by a second conveyor 3 which can be said to constitute a winnower and includes an elongated substantially horizontal conduit 4 (see also FIG. 2) which is driven (clockwise, as viewed in FIG. 1) to rotate about its substantially horizontal axis. The conduit 4 is provided with rows of axially parallel and/or circumferentially extending (and/or otherwise distributed) orifices 6 in the form of radial ports serving to discharge streamlets or jets or sprays (hereinafter jets) 11 of a suitable fluid conditioning medium into the aforementioned selected portion of the path for the descending shower of tobacco particles 1. The jets 11 orbit about the conduit 4 and establish a curtain 12 of finely distributed (such as atomized) conditioning medium; this curtain must be traversed by the tobacco particles 1 on their way toward the outlet 16 of the duct 2.

The orifices 6 can constitute the outlets of so-called Laval nozzles (for example, nozzles known as Model 630 and supplied by the Firm Schlick KG, Coburg, Federal Republic Germany).

The conduit 4 of the second conveyor 3 is connected with sources (schematically indicated by arrows 8 and 9) of suitable conditioning medium or media, e.g., with a source of water and a source of steam. When necessary, at least one of the sources 8, 9 can be used to furnish a stream of a suitable cleaning agent (e.g., water) for the interior of the conduit 4 and/or for the orifices 6 and/or for other parts of the improved apparatus. This will be described in greater detail hereinafter.

For example, the connection with two discrete sources of different conditioning media can be such that the conduit 4 alternatingly receives water (e.g., from the source denoted by the arrow 8) and steam (from the source indicated by the arrow 9). The configuration of the orifices 6 and the pressure of conditioning medium or media in the conduit 4 are (or can be) selected in such a way that the curtain 12 of fluid particles in the jets 11 forms a preferably continuous circulating curtain or cloud of fluid particles which orbit about the rotating conduit 4 and come into intimate contact with the tobacco particles 1 descending in the duct 2.

The inlet 10 of the duct 2 for tobacco particles 1 is designed to facilitate the moisturizing of such particles on their way into the curtain 12 of conditioning medium (such as steam) which is discharged into the selected portion of the path defined by the duct 2, namely into that portion of such path which is traversed by the conduit 4 of the second conveyor 3. The arrow 13 schematically represents a connection to a source of a suitable moisturizing agent (e.g., water) which is admitted into a set of nozzles 14 provided in the inlet 10 of the duct 2 and serving to furnish atomized particles of moisturizing or moistening agent from the source (13) into successive increments of the descending shower of tobacco particles 1 advancing into the range of the orbiting jets 11 of fluid conditioning medium (coming from the source 8 and/or from the source 9).

The means for supplying tobacco particles 1 into the inlet 10 (and into the range of the moisturizing agent discharged by the nozzles 14) comprises an extension or gate 16 of the duct 2 and a driven rotary cell wheel 17 in such extension. The latter can be of one piece with the inlet 10 of the duct 2.

The outlet 18 of the duct 2 discharges moistened and conditioned tobacco particles 1 into an elongated generally tubular dryer 19 which confines a stream 21 of a moisture reducing or expelling medium, e.g., hot air, which can but need not contain steam (such as superheated steam). As a rule, the temperature of the fluid in the dryer 19 will be in the range of between 150 and 600° C., especially between 200 and 400° C., most preferably about 300° C.

The illustrated dryer 19 slopes upwardly toward, past and beyond the outlet 18 of the duct 2 and comprises a cylindrical (tubular) lowermost portion 19*a* followed by a transition zone 19*b* which discharges into a tray-shaped central portion 19*c*. The latter is followed by a second transition zone 19*d* which, in turn, is followed by a cylindrical zone 19*e*. A diaphragm 22 is installed in the dryer 19 upstream of the outlet 18 and serves to reduce the pressure at such outlet, as well as to constrict the stream 21 of heated fluid in such a way that the latter prevents the gathering of accumulations of tobacco particles 1 and/or conditioning medium in the tray-shaped portion 19*c* opposite the outlet 18.

The arrangement is preferably such that the pressure of constricted heated drying (moisture reducing or expelling) medium (i.e., the stream 21) in the dryer 19 is only slightly above atmospheric pressure; this ensures that the drying medium does not interfere with entry of moisturized and conditioned tobacco particles 1 into the trough-shaped portion 19*c* of the dryer.

The means for propelling the conditioned tobacco particles 1 into the dryer 19 includes the second conveyor (winnower) 3. In order to promote the circulation of tobacco particles 1 about the rotating conduit 4 and the entry of such particles into the outlet 18, the conduit 4 is or can be provided with (optional but desirable) impellers in the form of radially extending needles or pins 7 (see particularly FIG. 2) which can alternate with the orifices 6 (as seen in the axial direction of the conduit 4). The impellers 7 can perform an additional highly important function, namely that of breaking up any agglomerations of tobacco particles 1 in the shower descending below the inlet 10 to thus ensure more uniform conditioning of tobacco particles.

Figure 2:
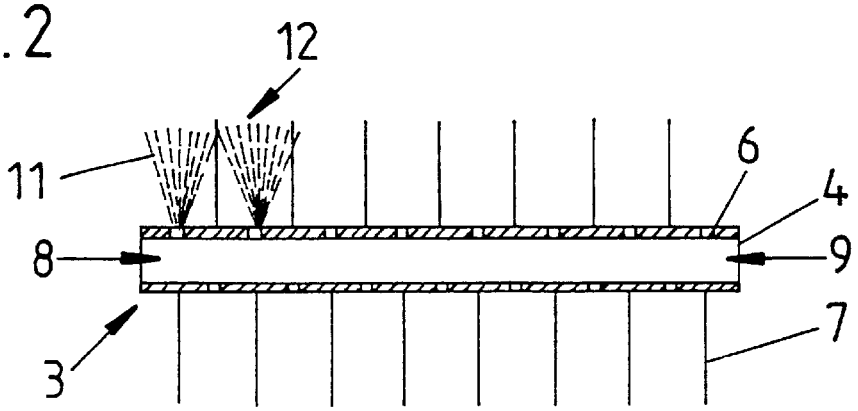
FIG. 2 is an enlarged fragmentary sectional view substantially as seen in the direction of arrows from the line II—II of FIG. 1 and shows a conduit which supplies a fluid conditioning medium into a selected portion of the path for partially gravitational and in part mechanically induced downward movement of a continuous stream of tobacco particles.

The operation of the apparatus of FIGS. 1 and 2 is as follows:

Batches of tobacco particles 1 which are supplied by the driven cell wheel 17 in the extension 16 form a more or less continuous shower of particles which descend in the duct 2 primarily or exclusively under the action of gravity and are adequately moistened by the fluid which is admitted (from the source 13) into the nozzles 14 at the inlet 10. As a rule, the moisturizing action is or can be selected in such a way that the moisture content of tobacco particles 1 descending in the duct 2 below the inlet 10 is between about 32 and 50%, preferably between about 40 and 45%.

The means (e.g., a variable-speed electric motor, not shown) for rotating the conduit 4 of the second conveyor 3 can be set to rotate the conduit 4 at about 200 RPM. One purpose of the rotating impeller pins or needles 7 is to break up eventual agglomerations of tobacco particles 1 while such particles are being contacted by atomized conditioning medium of the jets 11, i.e., by the curtain 12 of conditioning medium which orbits about the axis of the conduit 4. For example, the rate of feed of the stream of conditioning medium can be selected in such a way that the quantity of conditioning medium of the jets 11 is between about 0.3 and 0.6 kg per kilogram of tobacco entering the curtain 12. The pressure of the stream of conditioning medium in the conduit 4 is or can be such that the pressure of conditioning medium (jets 11) impinging upon the tobacco particles 1 in the selected portion of the path defined by the duct 2 is between 1 and 10 bar.

The conditioning medium in the conduit 4 can contain (or it can consist of) saturated steam which forms the orbiting curtain 12. The contents of such curtain cause the tobacco particles 1 to swell, i.e., to increase their specific volume as a result of a steam pressure rise in the fibers of the particles 1. Such rise of steam pressure is believed to be attributable to condensation heat which is released at the surfaces of and penetrates into the tobacco particles 1.

One presently preferred form of tobacco particles 1 is constituted by fragmentized (cut) tobacco ribs. Such particles leave the duct 2 via outlet 16 and enter the dryer 19 to be subjected to the action of heated drying medium flowing in the direction indicated by the arrows 21. The drying medium reduces the moisture content of conditioned tobacco particles 1 to an optimum value.

When the method including moisturizing, conditioning and drying of tobacco particles 1 is interrupted, the second conveyor (winnower) 3 can be put to use as a rotary cleaning implement. Thus, the conduit 4 can receive a stream of water (from the source denoted by the arrow 8 and/or by the arrow 9). Such stream is converted into a plurality of water jets 11 to thus clean the orifices 6 and the interior of the conduit 4 (as a result of continuous admission of additional fresh water at 8 and/or 9). In addition, the water jets clean the surrounding portion of the duct 2, the underside of the cell wheel 17, as well as the interior of the dryer 19 in the region of the outlet 18. The jets of clean water also clean the impeller pins or needles 7 at the exterior of the conduit 4.

Figure 3:
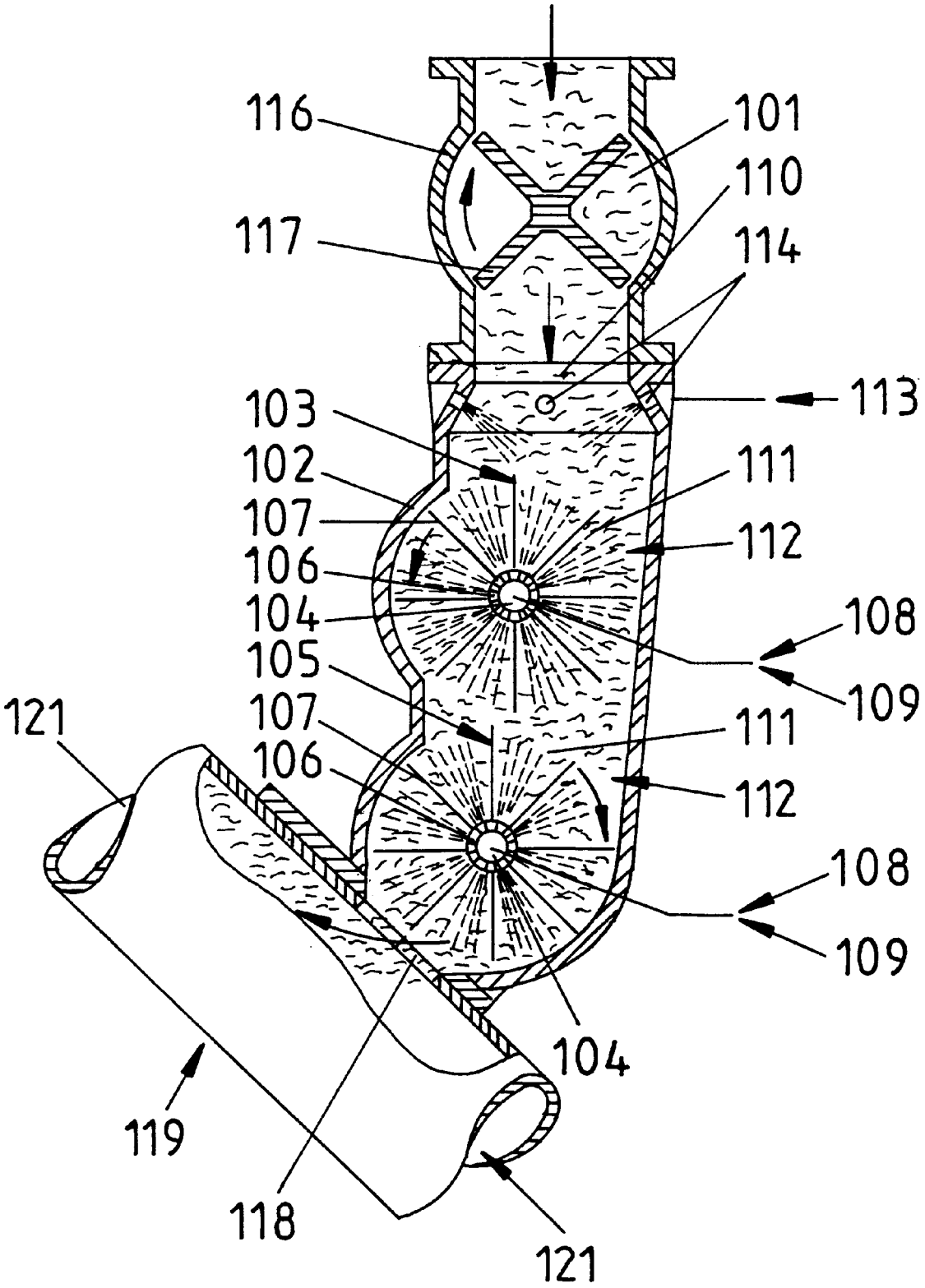
FIG. 3 is a view similar to that of FIG. 1 but showing a portion of a modified apparatus with two superimposed tobacco conditioning stations.

The (second) apparatus of FIG. 3 constitutes a first modification of the just described apparatus of FIGS. 1 and 2. All such parts of the second apparatus which are identical with or clearly analogous to the corresponding parts of the apparatus of FIGS. 1–2 are denoted by similar reference characters plus 100.

The height or length of the duct 102 between the inlet 110 and the outlet 118 has been increased so that the corresponding part of the vertical path defined by the duct 102 includes two selected portions, one above the other, each of which accommodates a transversely extending horizontal second conveyor 103, 105. Each of these second conveyors has a horizontal conduit 104 serving to convey a stream of a conditioning medium and to discharge radially outwardly flowing orbiting jets 111.

The apparatus of FIG. 2 can be put to use when it is desired to ensure an especially pronounced increase of specific volume of tobacco particles 101 and/or to simultaneously contact such particles with two or more different conditioning media.

Figure 4:
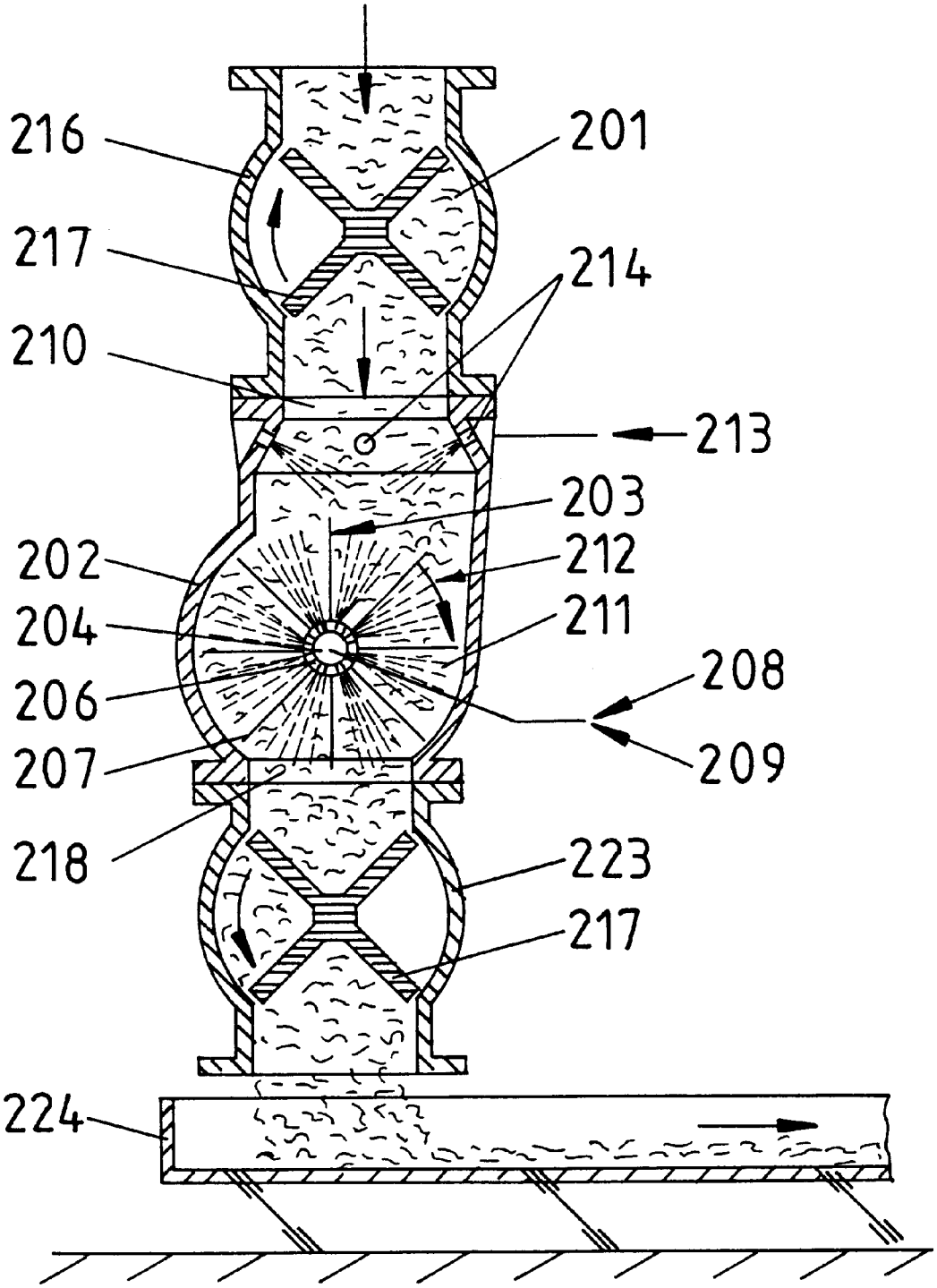
FIG. 4 is a fragmentary vertical sectional view of a third apparatus constituting a further modification of the apparatus which is shown in FIG. 1.

FIG. 4 shows a third apparatus. All such parts of this apparatus which are identical with or clearly analogous to the corresponding parts of the apparatus of FIGS. 1–2 are denoted by similar reference characters plus 200. The main difference between the apparatus of FIGS. 1–2 and the apparatus of FIG. 4 is that the latter is designed as a highly versatile (such as readily portable) aggregate which need not be provided or combined with a dryer 19 or 119.

The apparatus of FIG. 4 comprises a second cell wheel 217 in an extension 223 affixed to or made of one piece with the outlet 218 of the duct 202 and serving to deliver batches of conditioned tobacco particles 201 into a vibratory trough-shaped conveyor 224. The latter can transport conditioned tobacco particles 201 to an existing (standard) dryer (not shown) in a tobacco processing plant.

It goes without saying that the (second) conveyors or winnowers 103, 105 of FIG. 3, as well as the conveyor 203 of FIG. 4, can be utilized as a means for cleaning at least certain parts of the respective apparatus when such apparatus are not being utilized as a means for contacting tobacco particles (101 or 201) with one or more conditioning media. Thus, the conveyor 103 can clean the orifices 106 and the gate or extension 116 with the cell wheel 117; the conveyor 105 can clean the adjacent portion of the dryer 119; and the conveyor 203 can clean the extensions 216, 223, the nozzles 214 and the two cell wheels 217.

The improved method and apparatus are susceptible of numerous additional modifications without departing from the spirit of the invention. For example, the tobacco particles 1, 101 or 201 need not be moistened at the inlet 10, 110 or 210 of the respective duct 2, 102 or 202 but can be subject to such treatment well ahead of the respective duct as well as ahead of the respective extension 16, 116 or 216. The same applies for the breaking up of clumps by the implements 7, 107 and/or 207; such treatment can take place ahead (or even well ahead) of the respective inlet 10, 110 or 210.

The dryer 19 or 119 constitutes an optional but highly desirable and advantageous feature of the respective apparatus. The main purpose of the dryer is to ensure that the achieved state or condition of an increase of specific volume is preserved, i.e., that the expanded condition of tobacco particles 1 or 101 is stabilized as expeditiously as possible, namely immediately downstream of (below) the single second conveyor 3 or immediately downstream of the last (105) of a set of several successive second conveyors (103, 105).

An advantage of the jets 11, 111 and 211 is that they render it possible to reliably contact relatively large quantities of tobacco particles with one or more conditioning media per unit of time, i.e., this contributes to a higher output of the improved apparatus. The distribution of the orifices 6, 106 and 206 all around the axis of the respective conduit 3, 103 or 203 also contributes to a greater efficiency and to a higher output of the improved apparatus. The utilization of several second conveyors (103, 105 or more than two) is optional but highly desirable, especially if the improved apparatus is to process large quantities of tobacco particles (101) per unit of time and if the apparatus is to ensure highly uniform conditioning of tobacco particles. As already indicated above, it is equally within the purview of the invention to provide the apparatus with more than two second conveyors, e.g., to increase the height of the duct 102 in order to provide room for a further second conveyor (above the conveyor 103, below the conveyor 105 or between the conveyors 103, 105). All second conveyors may but need not be identical (this applies to their sizes, shapes and/or other characteristics).

Though it is conceivable and quite possible to advance the particles 1, 101 or 201 along a non-vertical path, reliance upon gravity for advancement of tobacco particles through their duct (such as 2, 102 or 202) is preferred at this time, for example, because the particles of a shower are more likely to remain separated from each other. Moreover, adequate acceleration of the particles 1 can be achieved with the cell wheel 17 and/or with the impellers 7, and the same holds true for the apparatus of FIG. 3 or 4.

The dimensions of the duct 2 in the region of the second conveyor 3 are selected with a view to ensure that this duct does not interfere with optimum swelling or expansion or increase of specific volume of the tobacco particles 1. This also applies for the corresponding portions of the ducts 102 and 202. Of course, the dimensions of the ducts 2, 102, 202 will also depend upon the nature and the extent of pretreatment of tobacco particles, e.g., upon the extent of moisturizing, the rate of admission of one or more conditioning media into the duct around the respective conduit or conduits, the nature of the conditioning medium or media, the rate of tobacco transport through the duct, the capacity of the dryer (if any), and/or certain other parameters (e.g., the nature of tobacco particles).

The impellers 7, 107 or 207 can also play an important role in connection with the throughput of the apparatus, the intensity of the conditioning treatment, the uniformity of such treatment (this depends upon the presence or absence of clumps and/or other accumulations of coherent (e.g., interlaced) tobacco particles in the area surrounding the respective conduit or conduits) and the versatility of the second conveyor or conveyors.

The placing of the moisturizing station into or close to the inlet 10, 110 or 210 of the respective duct 2, 102 or 202 exhibits the additional advantage that this contributes to compactness of the improved apparatus. The same holds true for the placing of the dryer (19 or 119) into immediate proximity of the outlet (18, 118) of the respective duct (2, 102) as well as for the placing of a cell wheel immediately ahead of the inlet (see the cell wheel 17 in the apparatus of FIG. 1) and for the placing of discrete cell wheels 217, 217 next to the inlet (210) and outlet (218) of the duct 202.

Still another important advantage of the improved apparatus is the aforediscussed ability of its second conveyor or conveyors to serve as a means for rapidly, effectively and reliably flushing the adjacent parts of the apparatus, e.g., with hot or cold water to expel remnants of tobacco particles and/or conditioning medium or media from the expansion chamber(s) and the neighboring regions.

A further advantage of the improved method and apparatus is that the tobacco particles are treated gently, uniformly and predictably, even if the apparatus is called upon to process relatively large quantities of tobacco particles per unit of time. Moreover, it has been found that the improved apparatus is capable of ensuring a pronounced increase of the specific volume of processed material. The method and the apparatus can be resorted to for the conditioning of all types of comminuted tobacco leaves in a small area and with relatively low consumption of energy. All parts of the apparatus are readily accessible, and the apparatus can be designed (refer again to FIG. 4) as a portable aggregate which can be installed in or utilized in conjunction with existing tobacco comminuting, conveying, storing and other equipment or aggregates. Moreover, the apparatus can be readily cleaned (particularly by resorting to its second conveyor or conveyors) without the need for even partial dismantling of the apparatus and/or of the associated equipment.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of conditioning tobacco and, therefore, such adaptations should and are intended to be comprehended within the meaning and range of equivalence of the appended claims.

What is claimed is:

1. A method of intimately contacting moist tobacco particles with a fluid conditioning medium, comprising the steps of establishing a free fall gravitational downward flow of moist tobacco particles along a predetermined path through a chamber from an inlet of the chamber to an outlet of the chamber; and inducing at least one substantially circular flow of the conditioning medium in a selected portion of said path so that the tobacco particles traverse and are contacted by conditioning medium in said substantially circular flow wherein said at least one circular flow contains an orbiting curtain of conditioning medium.

2. The method of claim 1, wherein said inducing step comprises conveying a stream of conditioning medium along a second path at least substantially transversely of and at least partially across said selected portion of said predetermined path, discharging jets of conditioning medium from and at least substantially radially of said second path, and orbiting said jets about said second path in said selected portion of said predetermined path.

3. The method of claim 1, wherein the conditioning medium contains steam which effects an increase of the specific volume of tobacco particles traversing said selected portion of said predetermined path.

4. The method of claim 1, further comprising the step of mechanically accelerating the tobacco particles at least in said intermediate portion of said predetermined path.

5. The method of claim 1, further comprising the step of moisturizing the tobacco particles in a second portion of said predetermined path above said selected portion.

6. The method of claim 1, further comprising the step of reducing the moisture content of tobacco particles in a further portion of said predetermined path subsequent to contacting of the particles with the conditioning medium in said selected portion of said predetermined path.

7. The method of claim 1, further comprising the step of drying the tobacco particles subsequent to traversal of said selected portion of said predetermined path.

8. The method of claim 1, wherein the inducing step includes supplying the conditioning medium into said selected portion of said predetermined path in the form of an array of jets issuing substantially radially from a source extending transversely of and across said selected portion, and orbiting the jets around said source.

9. The method of claim 1, wherein said inducing step includes establishing a plurality of at least substantially circular flows in successive selected portions of said predetermined path.

10. The method of claim 1, wherein said establishing step includes confining tobacco particles to a movement substantially vertically downwardly through said selected portion of said predetermined path.

* * * * *